US012428980B2

(12) United States Patent
Andrisani

(10) Patent No.: US 12,428,980 B2
(45) Date of Patent: Sep. 30, 2025

(54) INTEGRATED ROCKER FOR HIGH POWER ENGINE BRAKING

(71) Applicant: Eaton Intelligent Power Limited, Dublin (IE)

(72) Inventor: Nicola Andrisani, Cumiana (IT)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 18/786,275

(22) Filed: Jul. 26, 2024

(65) Prior Publication Data

US 2024/0384670 A1 Nov. 21, 2024

Related U.S. Application Data

(63) Continuation of application No. PCT/EP2023/025043, filed on Jan. 31, 2023.

(Continued)

(51) Int. Cl.
*F01L 13/06* (2006.01)
*F01L 1/18* (2006.01)

(Continued)

(52) U.S. Cl.
CPC ..... *F01L 13/065* (2013.01); *F01L 1/181* (2013.01); *F01L 1/2411* (2013.01); *F01L 1/26* (2013.01);

(Continued)

(58) Field of Classification Search
CPC ..... F01L 13/06; F01L 1/181; F01L 1/2411; F01L 1/26; F01L 1/46; F01L 2001/467; F01L 13/065; F01L 1/18
See application file for complete search history.

(56) References Cited

U.S. PATENT DOCUMENTS 4,768,475 A 9/1988 Ikemura
6,318,315 B1 * 11/2001 Harada ..... F01L 13/0036 123/90.15

(Continued)

FOREIGN PATENT DOCUMENTS

CN 111997704 A 11/2020
CN 115217568 A * 10/2022 ..... F01L 1/044

(Continued)

OTHER PUBLICATIONS

International Search Report and Written Opinion for International Application No. PCT/EP2023/025043 mailed on May 23, 2023, 12 pages.

(Continued)

*Primary Examiner* — Wesley G Harris
(74) *Attorney, Agent, or Firm* — Baker Botts L.L.P.

(57) ABSTRACT

An integrated exhaust rocker arm assembly capable of selectively enabling an engine braking mode includes an inner body, an outer body, and a switchable system for selectively operatively coupling the outer body to the inner body. The inner body includes a secondary roller. The outer body includes a cam end, a valve end, and a main roller. The valve end includes a brake capsule that comprises another switchable system configured to selectively extend a plunger body to act on a valve bridge. The valve end further includes a lost motion mechanism that permits selective translation of a lost motion shaft along a lost motion receiving passage for transmitting integrated exhaust rocker arm motion to the valve bridge.

19 Claims, 8 Drawing Sheets

Related U.S. Application Data

(60) Provisional application No. 63/304,996, filed on Jan. 31, 2022.

(51) Int. Cl.

| | |
|---|---|
| ***F01L 1/24*** | (2006.01) |
| ***F01L 1/26*** | (2006.01) |
| ***F01L 1/46*** | (2006.01) |
| ***F01L 13/00*** | (2006.01) |

(52) U.S. Cl.

CPC ..... *F01L 1/46* (2013.01); *F01L 13/0036* (2013.01); *F01L 2001/186* (2013.01); *F01L 2001/467* (2013.01); *F01L 2305/00* (2020.05); *F01L 2305/02* (2020.05)

(56) References Cited

U.S. PATENT DOCUMENTS

| | | | | |
|---|---|---|---|---|
| 6,412,460 | B1 | 7/2002 | Sato | |
| 6,604,498 | B2 | 8/2003 | Fernandez | |
| 7,827,958 | B2 | 11/2010 | Dietrich | |
| 9,016,249 | B2 * | 4/2015 | Roberts | F01L 1/18 123/90.39 |
| 11,181,012 | B2 * | 11/2021 | Alexandru | F01L 1/24 |
| 2003/0010305 | A1 | 1/2003 | Genise | |
| 2005/0205019 | A1 | 9/2005 | Burk | |
| 2010/0064994 | A1 | 3/2010 | Colliou | |
| 2010/0307434 | A1 * | 12/2010 | Odell | F01L 1/267 123/90.15 |
| 2010/0319642 | A1 | 12/2010 | Fujita | |
| 2011/0303168 | A1 * | 12/2011 | Ting | F01L 1/181 123/90.15 |
| 2014/0137823 | A1 | 5/2014 | Sugiura | |
| 2014/0238015 | A1 * | 8/2014 | Roberts | F01L 1/267 60/594 |
| 2014/0251266 | A1 | 9/2014 | Emmons | |
| 2017/0009610 | A1 | 1/2017 | Ahmed | |
| 2019/0055861 | A1 * | 2/2019 | Persson | F01L 13/065 |
| 2019/0145289 | A1 * | 5/2019 | Ferreira | F01L 13/065 123/90.55 |
| 2024/0011419 | A1 | 1/2024 | Raimondi | |
| 2024/0141808 | A1 | 5/2024 | Raimondi | |

FOREIGN PATENT DOCUMENTS

| | | | | |
|---|---|---|---|---|
| DE | 102009041368 | A1 | 3/2011 | |
| DE | 102011085708 | A1 | 5/2013 | |
| DE | 102011085709 | A1 | 5/2013 | |
| DE | 102018114572 | A1 | 12/2018 | |
| EP | 0607918 | B1 | 1/1996 | |
| EP | 0826867 | A1 | 3/1998 | |
| EP | 0978637 | A2 | 2/2000 | |
| EP | 1143120 | A2 | 10/2001 | |
| EP | 2625395 | B1 | 1/2014 | |
| EP | 2427642 | B1 | 7/2015 | |
| EP | 3170997 | A1 | 5/2017 | |
| GB | 2333322 | A | 7/1999 | |
| JP | 10-073009 | A | 3/1998 | |
| JP | 2000045737 | A | 2/2000 | |
| JP | 2001329817 | A | 11/2001 | |
| JP | 2009047111 | A | 3/2009 | |
| JP | 2009197732 | A | 9/2009 | |
| JP | 6305768 | B2 | 4/2018 | |
| WO | WO 2010100753 | A1 | 9/2010 | |
| WO | WO-2010126479 | A1 * | 11/2010 | F01L 1/08 |
| WO | WO 2010136875 | A1 | 12/2010 | |
| WO | WO 2011125194 | A1 | 10/2011 | |
| WO | WO-2012038195 | A1 * | 3/2012 | F01L 1/18 |
| WO | WO-2020253993 | A1 * | 12/2020 | F01L 1/181 |
| WO | WO 2023217415 | A1 | 11/2023 | |

OTHER PUBLICATIONS

International Search Report and Written Opinion for International Application No. PCT/EP2021/025464 mailed on Mar. 17, 2022, 12 pages.

International Search Report and Written Opinion for International Application No. PCT/EP2023/025224 mailed on Sep. 8, 2023, 11 pages.

International Search Report and Written Opinion for International Application No. PCT/EP2022/025100, mailed on Jun. 30, 2022, 17 pages.

* cited by examiner

INTEGRATED ROCKER FOR HIGH POWER ENGINE BRAKING

PRIORITY

This application is a continuation under 35 U.S.C. § 365 (c) of International Patent Application No. PCT/EP2023/025043, filed on 31 Jan. 2023, which claims the benefit under 35 U.S.C. § 119 of U.S. Application No. 63/304,996, filed on 31 Jan. 2022, all of which are incorporated herein by reference.

TECHNICAL FIELD

This application relates to rocker arm assemblies and, more particularly, to rocker arm assemblies with one or more switchable rollers that provide a compression braking function.

BACKGROUND

Compression engine brakes may be used as auxiliary brakes, in addition to wheel brakes, on relatively large vehicles powered by heavy or medium duty diesel engines. A compression engine braking system may be arranged, when activated, to provide early and/or additional opening of an engine cylinder's exhaust valve when the piston in that cylinder may be near a top-dead-center position of its compression stroke so that compressed air may be released through the exhaust valve. This may cause the engine to function as a power consuming air compressor, which may assist in slowing the vehicle.

In a typical valvetrain assembly used with a compression engine brake, the exhaust valve may be actuated by an exhaust rocker arm, which may engage the exhaust valve by means of a valve bridge. The exhaust rocker arm may rock in response to the lift profile of a cam on a rotating camshaft and may accordingly press down on the valve bridge, which may itself press down on one or more of the exhaust valves to open them.

The description provided herein is for the purpose of generally presenting the context of the disclosure. Work of the presently named inventors, to the extent it is described in this section, as well as aspects of the description that cannot otherwise qualify as prior art at the time of filing, are neither expressly nor impliedly admitted as prior art against the present disclosure.

SUMMARY OF PARTICULAR EMBODIMENTS

In particular embodiments, an integrated exhaust rocker arm assembly capable of selectively enabling one or more types of engine braking modes is disclosed, comprising: an outer body further comprising a valve end and a cam end; the valve end further comprising a brake capsule including a first switchable system, a lost motion mechanism; a main roller operatively coupled to the cam end of the outer body; an inner body configured to rotate about an axis parallel to the rocker shaft; a secondary roller operatively coupled to the inner body; and a second switchable system configured to selectively operatively couple the outer body to the inner body.

In particular embodiments, which may combine the features of some or all above embodiments, the lost motion mechanism further comprises an integrated hydraulic lash adjuster configured to compensate for lash between the lost motion shaft and the valve bridge.

In particular embodiments, which may combine the features of some or all above embodiments, the second switchable system comprises a roller latch assembly and a latch receiver assembly.

In particular embodiments, which may combine the features of some or all above embodiments, the second switchable system further comprises a first lost motion spring operatively coupled to the outer body and the inner body.

In particular embodiments, which may combine the features of some or all above embodiments, the roller latch assembly comprises a latch pin, the latch pin configured to move between a latched position, wherein the latch pin engages with the latch receiver assembly to constrain relative rotation between the inner body and the outer body, and an unlatched position, wherein the latch pin disengages from the latch receiver assembly to permit relative rotation between the inner body and the outer body.

In particular embodiments, which may combine the features of some or all above embodiments, the cam end of the outer body further comprises an outer axle bore for seating the latch receiver assembly of the latching axle assembly.

In particular embodiments, which may combine the features of some or all above embodiments, operative decoupling of the outer body and the inner body is associated with providing pressurized oil through a first controllable hydraulic line, the pressurized oil acting on the roller latch assembly.

In particular embodiments, which may combine the features of some or all above embodiments, the brake capsule is a hydraulic brake capsule.

In particular embodiments, which may combine the features of some or all above embodiments, the first switchable system comprises an actuator configured to selectively release oil pressure in the brake capsule.

In particular embodiments, which may combine the features of some or all above embodiments, the first plunger body occupying the first position is associated with providing pressurized oil through a second controllable hydraulic line, the pressurized oil acting on the actuator.

In particular embodiments, which may combine the features of some or all above embodiments, the actuator comprises a needle and a check ball, the needle comprising a longitudinal pin portion and a disk portion, the needle configured to selectively open the check ball.

In particular embodiments, which may combine the features of some or all above embodiments, the main roller operatively engages an engine braking lift profile of an engine braking cam, and wherein the secondary roller operatively engages an exhaust valve lift profile of an exhaust valve cam.

In particular embodiments, which may combine the features of some or all above embodiments, the lost motion mechanism is longitudinally aligned with the center of the valve bridge.

In particular embodiments, which may combine the features of some or all above embodiments, the brake capsule is longitudinally aligned with the first exhaust valve.

In particular embodiments, which may combine the features of some or all above embodiments, when one or more types of engine braking mode is disabled, the outer body and the inner body are operatively coupled by the second switchable system; and the first plunger body is retracted to a second position and configured into a collapsible state by the first switchable system, thereby preventing the first plunger body from exerting a valve opening force on the valve bridge, whereupon the lost motion mechanism selectively acts on the valve bridge based on rotation of a coupled member formed by the outer body and the inner body to open both exhaust valves based on an exhaust valve lift profile, the engine braking lift profile being absorbed by the lost motion mechanism.

In particular embodiments, which may combine the features of some or all above embodiments, further comprising a locking mechanism configured to selectively mechanically constrain the first plunger body to the second position when the engine braking mode is disabled.

In particular embodiments, which may combine the features of some or all above embodiments, when a first type of engine braking mode is enabled, a second switchable system is operated to decouple an outer body and an inner body, the integrated exhaust rocker arm assembly comprising the outer body, the inner body, a first switchable system and the second switchable system, the outer body configured to rotate about a rocker shaft and the inner body configured to rotate about an axis parallel to the rocker shaft; the first switchable system is operated to extend a first plunger body of a brake capsule to a first position during rotation of the outer body to a first angle, the outer body comprising the brake capsule, the first plunger body in the first position acting on a valve bridge of the valvetrain system and opening a first exhaust valve based on an engine braking lift profile, a second exhaust valve remaining closed based on a lost motion mechanism absorbing the engine braking lift profile and not acting on the valve bridge of the valvetrain.

In particular embodiments, which may combine the features of some or all above embodiments, when a second type of engine braking mode is enabled, operating a second switchable system to couple an outer body and an inner body together, the integrated exhaust rocker arm assembly comprising the outer body, the inner body, a first switchable system and the second switchable system, the outer body configured to rotate about a rocker shaft and the inner body configured to rotate about an axis parallel to the rocker shaft; and operating the first switchable system to extend a first plunger body of a brake capsule to a first position during rotation of the outer body to a first angle, the outer body comprising the brake capsule, the first plunger body in the first position acting on a valve bridge of the valvetrain system and opening a first exhaust valve a predetermined distance, a second exhaust valve remaining initially closed, whereupon, subsequent to the opening of the first exhaust valve the predetermined distance, further rotation of the outer body causes a lost motion mechanism of the outer body to act on the valve bridge to open the second exhaust valve while further opening the first exhaust valve.

In particular embodiments, which may combine the features of some or all above embodiments, when a cylinder deactivation mode is enabled, operating the second switchable system to decouple the outer body and inner body, operating the first switchable system to retract the first plunger body to a second position and configuring the first plunger body into a collapsible state, thereby preventing the first plunger body from exerting a valve opening force on the valve bridge; the lost motion mechanism absorbing the engine braking lift profile; whereupon both exhaust valves remain closed.

In particular embodiments, which may combine the features of some or all above embodiments, the lost motion mechanism comprising an integrated hydraulic lash adjuster that continually compensates for lash between the lost motion shaft and the valve bridge during operation of the valvetrain system.

In particular embodiments, which may combine the features of some or all above embodiments, when one or more types of engine braking mode are disabled, the method comprising, when the engine braking mode is disabled, operating the second switchable system to couple the outer body and the inner body; and operating the first switchable system to retract the first plunger body of the brake capsule to a second position, thereby preventing engagement of the first plunger body with the valve bridge of the valvetrain system, whereupon the lost motion mechanism of the outer body selectively acts on the valve bridge based on rotation of the outer body.

In particular embodiments, which may combine the features of some or all above embodiments, disclosing a valvetrain system of an engine, comprising an exhaust cam shaft comprising, per cylinder of the engine, an engine braking cam and an exhaust valve cam, the engine braking cam provided with an engine braking lift profile, the exhaust valve cam provided with an exhaust valve lift profile; an outer exhaust rocker arm body configured to rotate about a rocker shaft, the outer exhaust rocker arm body comprising a valve end and a cam end opposite the valve end, the valve end configured to selectively engage a first exhaust valve and a second exhaust valve by selectively acting on a valve bridge, the valve end of the outer body further comprising a brake capsule, the brake capsule comprising a first switchable system configured to selectively extend a first plunger body to a first position to act on the first exhaust valve through the valve bridge; and a lost motion mechanism comprising a lost motion shaft configured to selectively translate along a lost motion receiving passage for transmitting motion of the outer body to the valve bridge, the lost motion mechanism further comprising an integrated hydraulic lash adjuster configured to compensate for lash between the lost motion shaft and the valve bridge; a main roller operatively coupled to the cam end of the outer body, the main roller operatively engaging the engine braking lift profile of the engine braking cam; an inner body configured to rotate about an axis parallel to the rocker shaft; a secondary roller operatively coupled to the inner body, the secondary roller operatively engaging the exhaust valve lift profile of the exhaust valve cam; a second switchable system configured to selectively operatively couple the outer body to the inner body to enable or disable the engine braking mode; and a plurality of exhaust valves comprising at least one first exhaust valve and at least one second exhaust valve.

BRIEF DESCRIPTION OF THE DRAWINGS

The present invention will be described in greater detail below based on the exemplary figures. The invention is not limited to the exemplary embodiments. Other features and advantages of various embodiments of the present invention will become apparent by reading the following detailed description with reference to the attached drawings which illustrate the following.

DESCRIPTION OF EXAMPLE EMBODIMENTS

Several figures disclosed herein illustrate one or more rocker arm assemblies with roller deactivation for valvetrains used in internal combustion engines, according to particular embodiments. Further, the present disclosure may be applied to, or used in connection with, many types of valvetrain systems and configurations comprising one or more cam-actuated rollers. While the disclosed embodiment may be particularly beneficial for high power engines and/or heavy-duty vehicles and machines, the present disclosure may be applied to, or used in connection with, many other types of vehicles and applications. In particular embodiments, an integrated exhaust rocker arm assembly may be configured to support compression engine braking actuation mechanisms.

During engine braking, high power internal combustion engines may exert large forces on valvetrains in general, and on exhaust rocker arm assemblies in particular, based on their high cylinder pressures. As a non-limiting example, cylinder pressures in high power engines may exceed 90 bar. Sizing and designing exhaust rocker arm assemblies to robustly withstand and reliably operate under such large forces may necessitate physically increasingly large and massive assemblies that may introduce design challenges for balancing cost, complexity, dynamic loads, performance, and/or packaging constraints. Additionally, it may be challenging to provide means for overcoming mechanical lash in complex valvetrains for high power engines, particularly for last compensation operating during both engine braking and normal exhaust modes. Providing such functionality and features in a compact and robust assembly requires inventive design.

In particular embodiments, an integrated exhaust rocker arm assembly for enabling engine braking disclosed herein may provide a robust and simplified solution in a compact packaging for supporting large compression braking forces in high power engines. Separately or additionally, particular embodiments disclosed herein permit integration of a hydraulic lash adjustment system to compensate for mechanical lash, whether engine braking mode is enabled or disabled during engine operation. Separately or additionally, particular embodiments disclosed herein may provide engine braking solutions that may combine cylinder deactivation features. Further details will be provided herein with reference to the figures.

Figure 1:
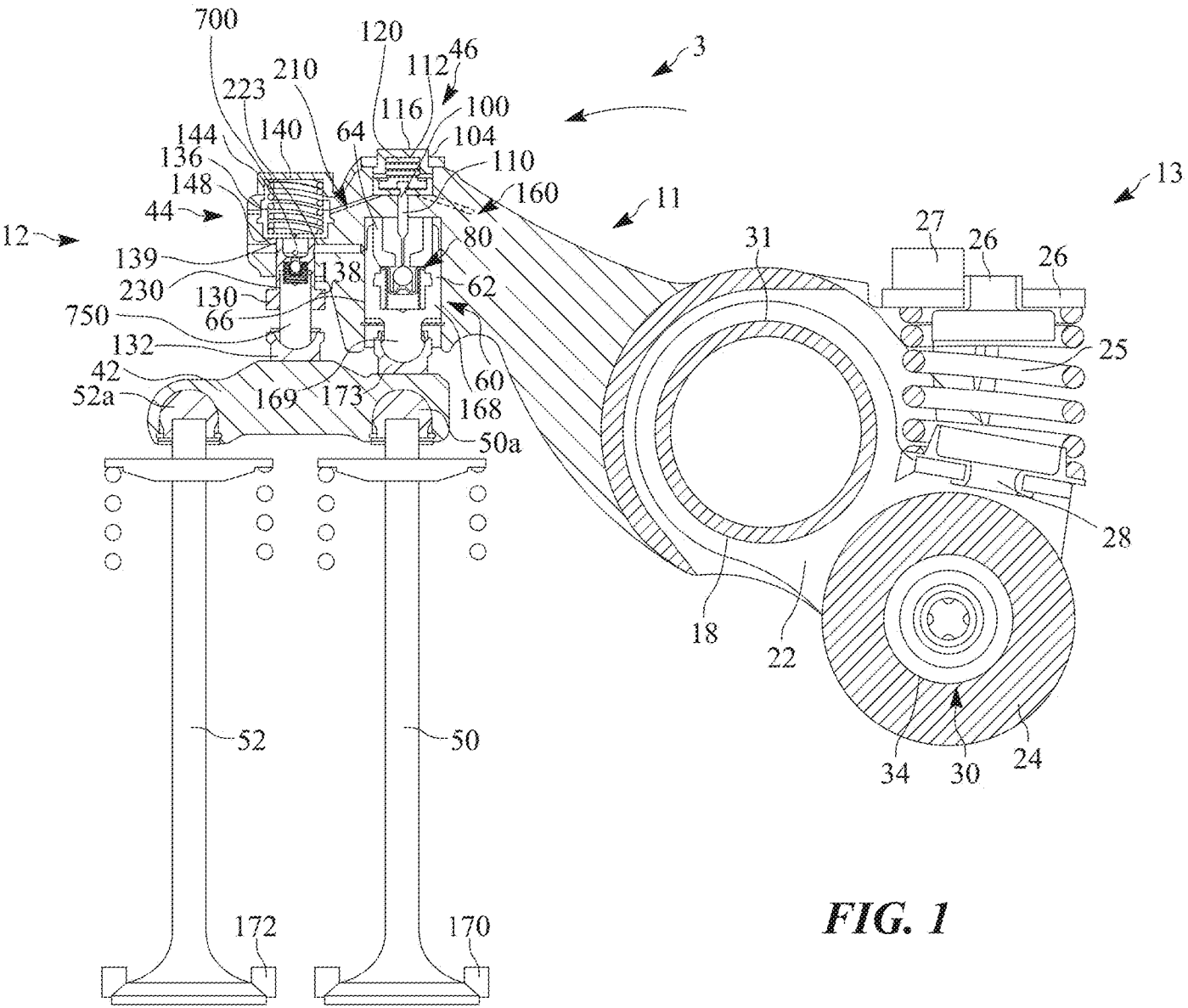
FIG. 1 illustrates a schematic cut-away profile view of a rocker arm assembly with switchable roller deactivation, according to particular embodiments.
Figure 2:
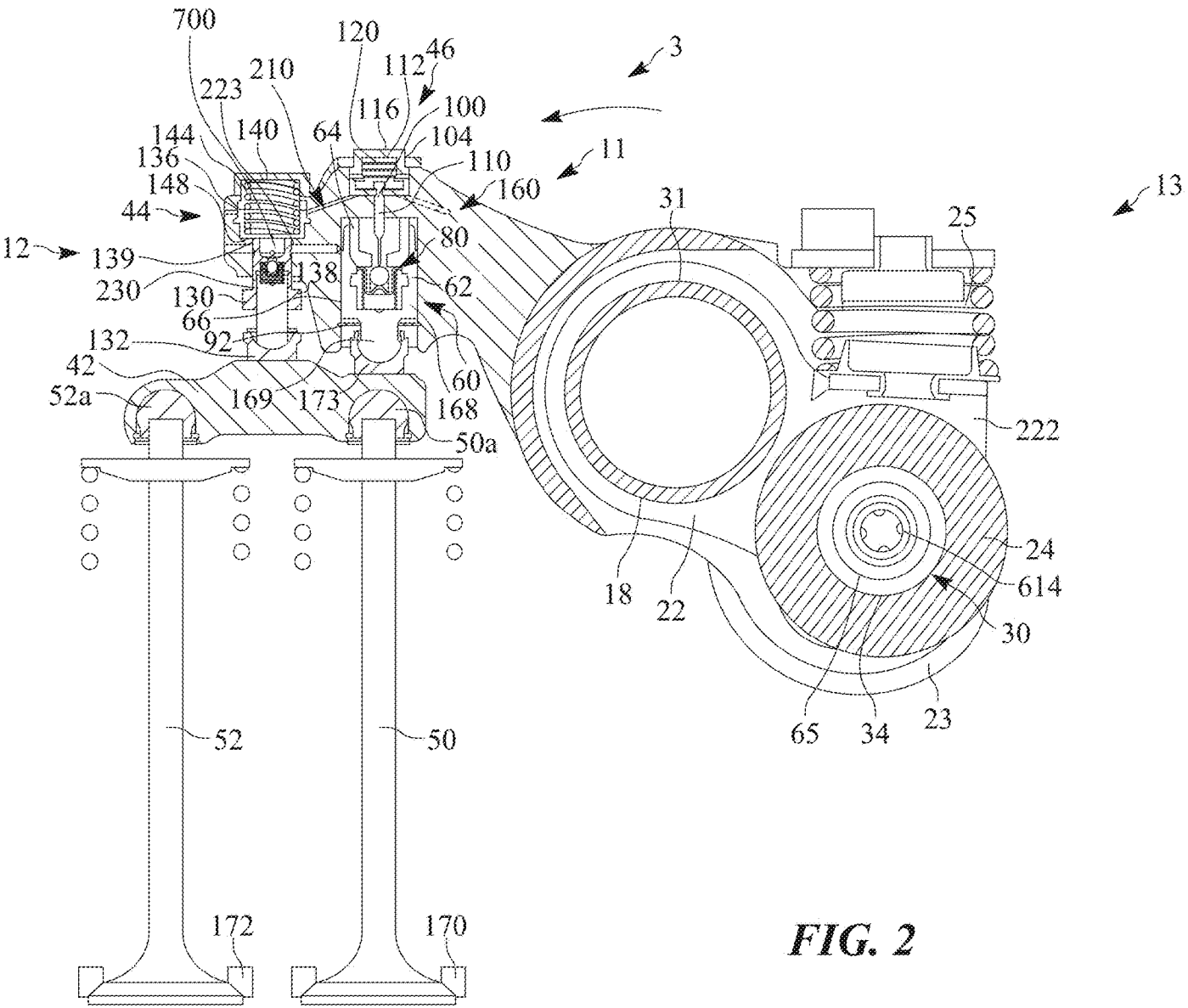
FIG. 2 illustrates a schematic cut-away profile view of a rocker arm assembly with switchable roller deactivation, depicting an offset roller, according to particular embodiments.

FIGS. 1 and 2 illustrate schematic cut-away profile views of a rocker arm assembly 3 with switchable roller deactivation, according to particular embodiments.

A rocker arm assembly 3 may comprise outer body 11 in particular embodiments. Outer body 11 may be configured to rotate about a rocker shaft 18, which may optionally be substituted with a pivoting axle or other suitable structure. As one option, a bushing for surrounding the rocker shaft 18 may be inserted in the outer shaft bore 17, and/or may be fitted on the rocker shaft 18.

Figure 3:
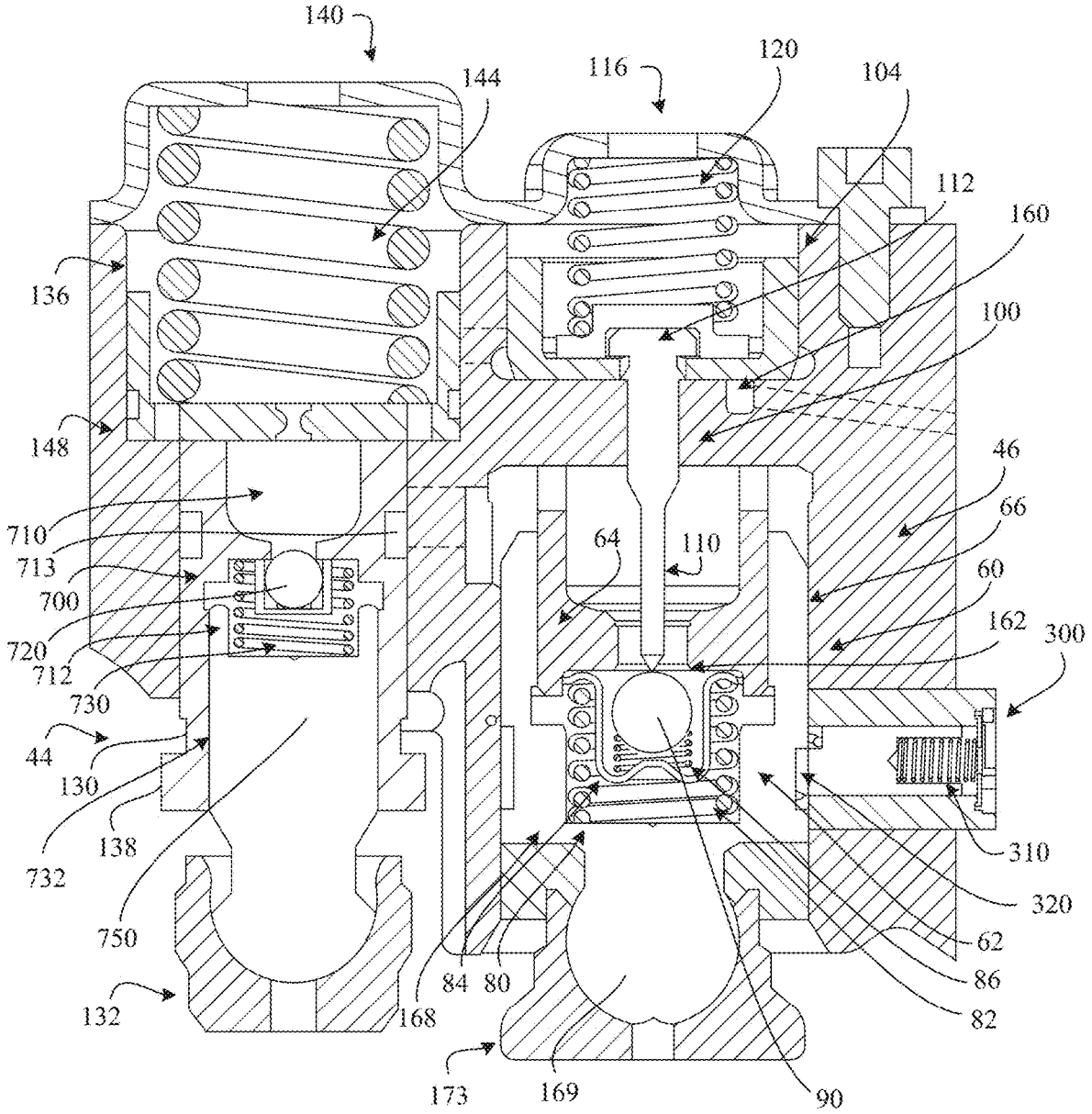
FIG. 3 illustrates a schematic cut-away partial profile view of a valve end of a rocker arm assembly, according to particular embodiments.

In particular embodiments, outer body 11 may further comprise a valve end 12, which may include a valve bridge 42, a lost motion mechanism 44, and a brake capsule 46. FIG. 3 illustrates a schematic cut-away partial profile view of a valve end 12 of a rocker arm assembly 3, according to particular embodiments, illustrating additional details and features.

In particular embodiments, valve bridge 42 may engage a first exhaust valve and a second exhaust valve 50 and 52, respectively, associated with a cylinder of an engine (not shown). The first and second exhaust valves 50 and 52 may have a corresponding elephant foot, or E-foot, 50*a* and 52*a*, respectively. The E-feet 50*a* and 52*a* may allow the valve bridge 42 to move without creating any side load on the corresponding stems of valves 50 and 52. In particular embodiments, E-foot 50*a* may be spherical. In particular embodiments, E-foot 52*a* may be cylindrical.

In particular embodiments, brake capsule 46 may be hydraulically actuated and/or controlled, and may comprise a plunger assembly 60, including a first plunger body 62, and a second plunger body 64. The second plunger body 64 may be partially received by the first plunger body 62. The plunger assembly 60 may be received by a first bore 66 defined in rocker arm assembly 3. The first plunger body 64 may have a first closed end 168 that defines a first spigot 169, which may be received in a first socket 173 that may act against the valve bridge 42. The second plunger body 64 may have an opening defining a valve seat 76. A check ball assembly 80 may be positioned between the first and second plunger bodies 62 and 64, respectively. The check ball assembly 80 may include a first biasing member 82, a cage 84, a second biasing member 86 and a check ball 90. A snap ring 92 may nest in a radial groove provided in the first bore 66 of rocker arm assembly 3. The snap ring 92 may retain the first plunger body 62 in the first bore 66.

An actuator or needle 100 may be received in a second bore 104 of rocker arm assembly 3. The needle 100 may act as an actuator that selectively releases pressure in the brake capsule 46. The needle 100 may include a longitudinal pin portion 110 and an upper disk portion 112. A first cap 116 may be fixed to rocker arm assembly 3 with a plate and/or a plurality of fasteners at the second bore 104, and may capture a biasing member 120 therein. The biasing member 120 may act between the first cap 116 and the upper disk portion 112 of the needle 100. In the non-limiting example shown, the biasing member 120 may bias the needle 100 downward, as illustrated in at least FIGS. 1-3. As a non-limiting example, biasing member 120 may comprise a spring.

In particular embodiments, pressurized hydraulic fluid, such as oil, may be selectively supplied to upper disk portion 112 via a hydraulic supply passage 160 (partially illustrated in FIGS. 1-2). As a non-limiting example, based on receiving one or more control signals, an oil control valve (OCV) may be used to permit or prevent flow of pressurized hydraulic fluid in hydraulic supply passage 160. Additional aspects of supply and/or control of pressurized hydraulic fluid and/or control fluid will be described in further detail in a later section.

In particular embodiments, when hydraulic supply passage 160 has a low pressure level and/or is not supplied with pressurized oil, upper disk portion 112 of actuator or needle 100 may be biased downward by biasing member 120, holding check ball 90 open and permitting oil flow around and past valve seat 162. Consequently, this may cause brake capsule 46 to become "soft," i.e., enter a collapsible state and become incapable of influencing or exerting an opening force upon the valve bridge 42.

In particular embodiments, when hydraulic supply passage 160 has a high pressure level and/or is supplied with suitably pressurized oil, upper disk portion 112 of actuator or needle 100 may be lifted up against the bias of biasing member 120. As a result, longitudinal pin portion 110 may move away from check ball 90, closing the check ball 90 against valve seat 162. Consequently, brake capsule 46 may act as a no-return valve, with the first plunger body 62 extending toward valve bridge 42, with a rigid structure relative to a valve opening force to be exerted upon valve bridge 42.

As a result, in particular embodiments, brake capsule 46 may provide a switchable system for selectively enabling or disabling the ability of first plunger body 62 to influence or exert an opening force on valve bridge 42 and/or exhaust valve 50 (also called brake valve 50). Although this disclosure describes providing particular means of actuation and/or control of a brake capsule, this disclosure contemplates providing any suitable means of actuation and/or control of one or more capsules, such as brake capsules, in any suitable manner. As a non-limiting example, In particular embodiments, brake capsule 46 may be electrically actuated and/or controlled.

In particular embodiments, brake capsule 46 may be longitudinally aligned with an exhaust valve 50 designated as a brake valve 50.

As a non-limiting example, in particular operating modes, such as when an engine braking mode is disabled, brake capsule 46 may continue to cyclically extend and compress with engine cycles, which may cause unnecessary flow of hydraulic fluid, such as oil. In particular embodiments, a capsule locking mechanism 300 may be optionally provided to reduce redundant flow and/or consumption of hydraulic fluid and/or control fluid, such as oil. In particular embodiments, capsule locking mechanism 300 may comprise a capsule locking pin 310 that may be selectively extensible to engage with a suitable feature of brake capsule 46, such as groove 320 of first plunger body 62, to constrain the first plunger body 62 in a collapsed or retracted position.

As non-limiting examples, capsule locking pin 310 may be selectively extended using a hydraulic actuator, or using an electric actuator. By way of illustration and not limitation, a hydraulic actuator may comprise an oil pressure control mechanism to control oil pressure to a piston or plunger, optionally combined with one or more biasing elements, such as springs. By way of illustration and not limitation, an electric actuator may comprise an electric motor controllable by an external signal based on requirement. While a capsule locking mechanism 300 may be illustrated in a subset of figures, such as FIG. 3, capsule locking mechanism 300 is contemplated with any or all other embodiments disclosed herein.

In particular embodiments, a lost motion mechanism 44 may be incorporated into a rocker arm assembly 3. Lost motion mechanism 44 may generally include a lost motion shaft 130 having a distal end that may be received by a second socket 132, and a proximal end that may extend into a third bore 136 defined in rocker arm assembly 3. A collar 138 may extend from an intermediate portion of the lost motion shaft 130. The lost motion shaft 130 may extend through a passage 139 formed through rocker arm assembly 3. A second cap 140 may be fixed to rocker arm assembly 3 at the third bore 136 and may capture a biasing member 144 therein. The biasing member 144 may act between the second cap 140 and a snap ring 148 fixed to the proximal end of the lost motion shaft 130. As will be further described, the lost motion shaft 130 may remain in contact with rocker arm assembly 3, and may be permitted to translate along its axis within the passage 139.

In particular embodiments, lost motion mechanism 44 may be longitudinally aligned with or near the center of valve bridge 42, so as to be capable of influencing and/or exerting open force on both exhaust valves 50 and 52, when intended.

In particular embodiments, valve bridge 42 may be in contact with a pin sliding through a hole, the pin receiving valve lift from brake capsule 46, valve bridge 42 making contact with a first exhaust valve 50. In particular embodiments, valve bridge 42 may separately or additionally receive valve lift from lost motion mechanism 44, and valve bridge 42 may be in contact with a second exhaust valve 52.

In particular embodiments, a hydraulic lash adjuster 700, or HLA 700, may be optionally incorporated into lost motion mechanism 44. Hydraulic lash adjuster 700 may provide compensation for lash (not shown) between the lost motion shaft 130 and the valve bridge 42. In particular embodiments, HLA 700 integrated into lost motion mechanism 44 may provide lash compensation for both non-braking exhaust valve operation as well as engine braking valve operation. As a non-limiting example, hydraulic lash adjuster 700 may be capable of expanding to close and/or eliminate mechanical lash. Separately or additionally, hydraulic lash adjuster 700 may be capable of collapsing as needed, to ensure that one or more engine valves that may be intended to fully close are permitted to do so as and when intended, by design. One or more engine valves unintentionally not fully closing may affect engine performance, sometimes severely so. As a non-limiting example, it may be desired for hydraulic lash adjuster 700 to partially collapse based on thermal expansion of the components of rocker arm assembly 3 and/or other aspects of the valvetrain.

As illustrated with additional detail in at least FIG. 3, according to particular embodiments, a hydraulic lash adjuster 700, or HLA 700, may comprise an upper HLA chamber 710 and a lower HLA chamber 712. Pressurized oil may be supplied to hydraulic lash adjuster 700 by one or more hydraulic lines provided (not shown) in the rocker arm assembly 3. By way of example and not limitation, a continuous supply of pressurized oil may be provided by an engine oil pump (not shown) and/or the engine's hydraulic fluid supply. In particular embodiments, an HLA refilling channel 223 may be used to refill the HLA with oil drawn from the engine oil pump.

In particular embodiments, upper HLA chamber 710 may function as a pressurized hydraulic fluid reservoir. As a non-limiting example, pressurized hydraulic fluid may enter upper HLA chamber 710 through a first aperture 713. A one-way valve, such as HLA check ball 720, may selectively restrict or permit hydraulic fluid flow between upper HLA chamber 710 and lower HLA chamber 712. Forces may be transferred between exhaust valves 50, 52 and rocker arm assembly 3 through the valve bridge 42, plunger 750, and the oil in lower HLA chamber 712. In particular embodiments, one or more HLA biasing elements 730 may be provided. As a non-limiting example, an HLA biasing element 730 may be a spring.

In operation, hydraulic fluid (such as oil) may flow into lower HLA chamber 712 via a one-way valve, such as HLA check ball 720, but may escape lower HLA chamber 712 only slowly via one or more precise and very small leak surfaces, gates, or channels. Accordingly, HLA 700 may extend to accommodate slack or lash in rocker arm assembly 3 during part of the engine cycle, such that HLA check ball 720 may open, allowing the lower HLA chamber 712 of the expanding hydraulic lash adjuster 700 to pull in oil from upper HLA chamber 710. Subsequently, after HLA 700 is extended to overcome any lash, check ball 720 may close based on the increasing transferred forces from an exhaust valve, such as 50, 52, substantially trapping the relatively incompressible hydraulic fluid in the lower HLA chamber 712, providing rigid, or nearly rigid, support for the rocker arm assembly 3. In other words, the hydraulic fluid may prevent the plunger 750 being pushed inward, so that HLA 700 may act as a solid body or nearly solid body for force transfer.

In particular embodiments, a small quantity of oil may flow or leak out of the hydraulic lash adjuster 700, by design. By way of example and not limitation, a precisely controlled radial gate may be provided for releasing a small, metered quantity of leakage oil, such as during every engine cycle involving opening and closing of engine valves. In particular embodiments, such low leakage flows of oil out of the hydraulic lash adjuster 700 may occur through and past an interface at the outer diameter of plunger 750, such as interface 732. As a non-limiting example, the hydraulic fluid escaping through leak surfaces, gates, or channels may flow back into upper HLA chamber 710.

In particular embodiments, HLA 700 may extend only after lost motion shaft 130 has completed its extension. Extension of HLA 700 may compensate for a mechanical lash increase in the system and ensure that all components may be in contact prior to the next valve lift event. In particular embodiments, HLA 700 may collapse by a small amount during valve lift events due to oil leakage, which may be driven by high oil pressures when HLA 700 may be under load. As mentioned, HLA 700 may only collapse in a very controlled manner under load, based on the precise, small dimensions and geometry of leakage paths designed and implemented. As a non-limiting example, the dimensions of the outer diameter of plunger 750 relative to the inner diameter of lost motion shaft 130 may provide part of the metering to control leakage and collapse rate of HLA 700.

FIGS. 1 and 2 also illustrate switchable roller deactivation aspects of rocker arm assembly 3, among other features relating to cam end 13 and inner body 22. These aspects will be further detailed below, with reference to several relevant figures.

For instance, FIGS. 1 and 2 depict a secondary roller 24 in a cam base circle position (FIG. 1), and in an offset position (FIG. 2). Generally, a cam mounted on a camshaft may be rotated, and the rotating cam may exert force on a roller, directly or indirectly. The profile of the cam may include one or more lobes that provide lift profiles corresponding to desired valve lift events. Cam base circle positions of a roller correspond to instantaneous engagement of a roller with portions of the cam profile where there are no lobes, i.e., a zero-lift part of the cam profile, and the force exerted by the cam on a roller, directly or indirectly, may be at a minimum. Cam lift mode positions correspond to portions of the cam profile where there are cam lobes, i.e., non-zero lift profiles, and the force exerted by the cam on a roller, directly or indirectly, may be greater relative to the pressure exerted by the cam in cam base circle position so as to cause the valve end to move one or more affiliated valve.

Figure 7:
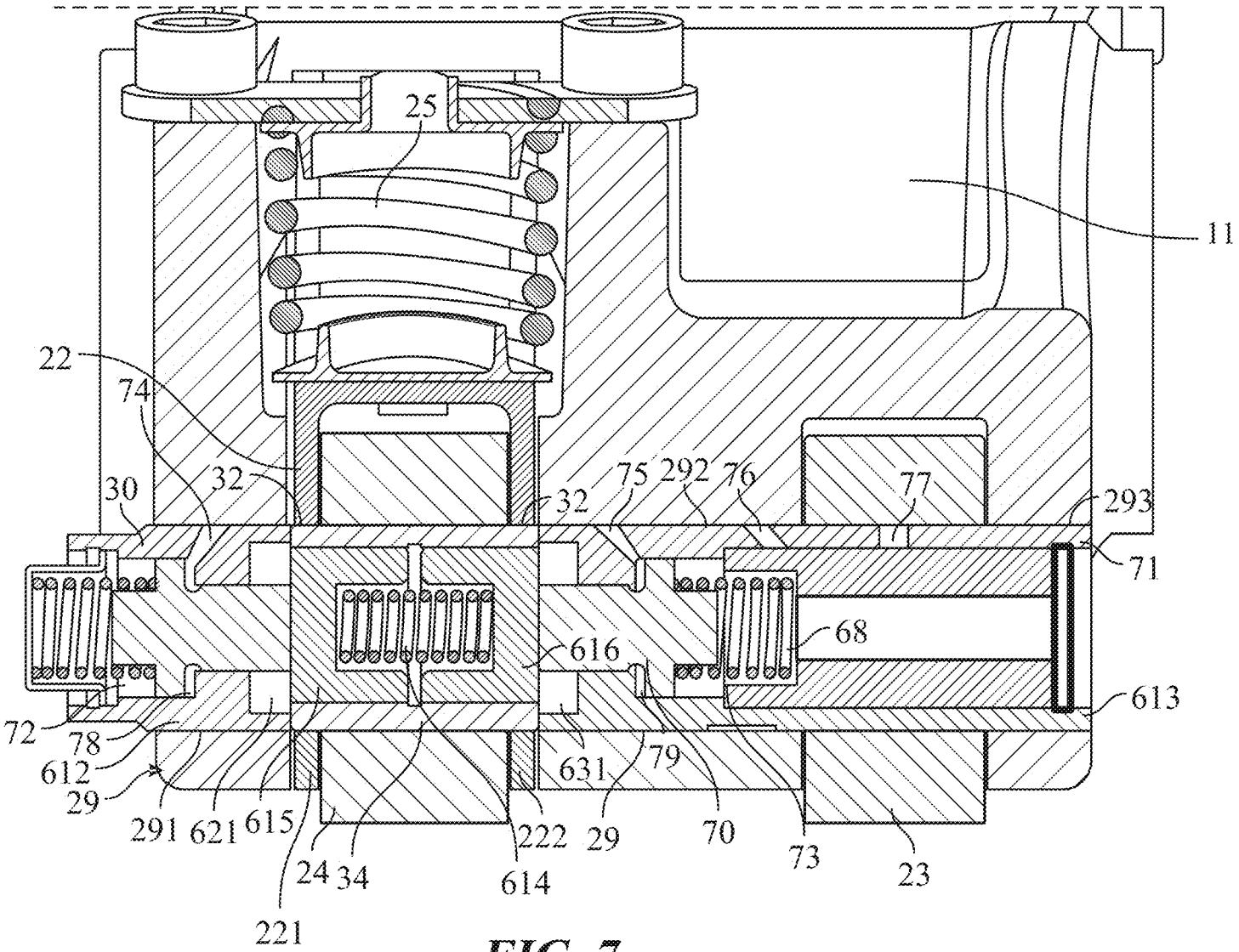
FIG. 7 illustrates a schematic partial cut-away profile view of a cam end and inner body of a rocker arm assembly with switchable roller deactivation in unlatched mode, the cut-away taken approximately at line S-S of FIG. 6, according to particular embodiments.

At least FIGS. 1 and 7 illustrate rocker arm assembly 3 in a cam base circle position, with no valve lift force applied by a camshaft lobe on secondary roller 24. For instance, FIG. 7 illustrates inner body 22 in unlatched mode, but still in cam base circle position, and not offset.

In particular embodiments (not shown), inner body 22 may be configured to rotate about rocker shaft 18. In particular embodiments (not shown), inner body 22 may be configured to rotate about an axis parallel to rocker shaft 18, the axis of rotation of inner body 22 being not necessarily coincident with the axis of rocker shaft 18.

In particular embodiments, lost motion spring 25 acting on inner body 22 may position secondary roller 24 to be on the same axis as main roller 23 in FIG. 1, such that the two rollers 23, 24 may be aligned on the same axis. While secondary roller 24 may be aligned with main roller 23 on the same axis in a cam base circle position, configurations in other contemplated embodiments may include secondary roller 24 being offset from main roller 23 in a cam base circle position.

In FIGS. 1 and 2, inner shaft bore 31 is illustrated in the cross-section of inner body 22. In particular embodiments, rocker shaft 18 may pass through inner shaft bore 31. As a non-limiting example, rocker shaft 18 may traverse outer body 11 and inner body 22, may couple outer body 11 with inner body 22, and/or may allow inner body 22 to pivot with respect to outer body 11, and vice versa. Latching axle assembly 30, via axle bore 29, may pass through main roller 23 and secondary roller 24, outer body 11, and inner body 22.

FIG. 2 illustrates a schematic cut-away profile view of a rocker arm assembly with switchable roller deactivation, depicting an offset roller, according to particular embodiments. As FIG. 2. illustrates, the rocker arm assembly 3 with a secondary roller 24 may be in an unlatched mode. As illustrated in FIG. 2, a camshaft lobe in a cam lift mode position may drive secondary roller 24 and inner body 22 upwards. Secondary roller 24 and inner body 22 may thus pivot with respect to outer body 11 along the axis (facing into and out from the page) defined by inner shaft bore 31 and rocker shaft 18.

This motion may also compress lost motion spring 25 between outer body 11 and inner body 22. Thus, at least some of the force from the camshaft lobe and a portion of the resulting motion may be absorbed by the lost motion spring 25. If the lost motion spring 25 absorbs all of the force, the secondary roller 24 may be considered completely deactivated. In particular embodiments, it may be also possible for a portion of the force from the camshaft lobe motion to be conveyed to valve end 12 for a partially deactivated valve lift function. Note that main roller 23 may remain fixed with respect to outer body 11, even while secondary roller 24 may be movable with respect to outer body 11. When the cam returns to a cam base circle position, the force from the camshaft lobe subsides and lost motion spring 25 may drive inner body 22 and secondary roller 24 back to the approximate configuration shown in FIG. 1.

In particular embodiments, rocker arm assembly 3 may be used for selective engine mode (EB) operation, with one or more types of engine braking modes being selectively enabled or disabled.

In particular embodiments, rocker arm assembly 3 may be configured for selectively enabling or disabling 1.5-stroke engine braking (1.5S EB) modes. As a non-limiting example, use of rocker arm assembly 3 in this context may be particularly beneficial for high power engines as the large forces from the cylinder gases to the rocker arm assembly 3 may be usefully divided among at least two rollers, while retaining the smaller space claim, mass, and reduced complexity of a single rocker architecture. Additional operational details of rocker arm assembly 3 configured for selective 1.5-stroke engine braking (EB) will be provided in a later section.

In particular embodiments, rocker arm assembly 3 may be configured for selectively enabling or disabling 1-stroke engine braking (1S EB) modes. As a non-limiting example, use of rocker arm assembly 3 in this context may be particularly combined in some case with the ability to provide selective cylinder deactivation (CDA), while retaining the smaller space claim, mass, and reduced complexity of a single rocker architecture. Additional operational details of rocker arm assembly 3 configured for selective 1-stroke engine braking (EB) and/or cylinder deactivation (CDA) will be provided in a later section.

In particular embodiments, exhaust rocker arm assembly 3 may be configured for 2-stroke engine braking (2S EB) modes in a functionally similar way to 1.5S EB disclosed herein; differences between 1.5S and 2S EB may arise on the intake side of engine valvetrains, not considered in this disclosure. 1.5-stroke (1.5S) and/or 2-stroke (2S) engine braking arrangements may provide greater braking power than 1-stroke (1S) engine braking arrangements. However, 1.5S/2S engine braking arrangement may comprise more components than a 1S engine braking arrangement, and may therefore be more complicated, more expensive, and/or occupy more space than a 1S engine braking arrangement.

In particular embodiments, separate cams for normal ("normal" denoting with engine braking disabled) exhaust valve lift and for engine braking exhaust valve lift may be used to engage the rocker arm assembly 3.

An engine braking cam, featuring an engine braking lift profile corresponding to compression release-based engine braking exhaust valve operation, may be engaged to main roller 23. In particular embodiments that may feature 1.5-stroke or 2-stroke engine braking modes, as a non-limiting example, a dedicated engine braking lift profile may be designed to open an exhaust valve, such as exhaust valve 50 (also called brake valve 50), three or more times per cam rotation, when engine braking mode is enabled. In particular embodiments that may feature 1-stroke engine braking and/or cylinder deactivation (CDA) modes, as a non-limiting example, an engine braking lift profile may be designed to open an exhaust valve, such as exhaust valve 50 (also called brake valve 50), one or more times per cam rotation, when engine braking mode is enabled.

An exhaust valve cam, featuring an exhaust valve lift profile corresponding to a non-engine braking mode, i.e., "normal" exhaust valve operation, may be engaged to secondary roller 24. In particular embodiments that may feature 1.5-stroke (1.5S) engine braking modes, as a non-limiting example, the "normal" exhaust valve lift profile may be disabled or otherwise suppressed from operating on or providing lift to any exhaust valves when engine braking mode is enabled. In particular embodiments that may feature 1-stroke (1S) engine braking and/or cylinder deactivation (CDA) modes, as a non-limiting example, the "normal" exhaust valve lift profile may operate in conjunction with, and/or with a delay following, application of an engine braking lift profile when engine braking mode is enabled.

In particular embodiments featuring selective 1-stroke engine braking (1S EB) or 1.5-stroke engine braking (1.5S EB) mode operation, when engine braking mode is disabled, the switchable roller mechanism, which will be further detailed in a later section and may be provided in part or whole by latching axle assembly 30, may be configured in latched mode, thereby coupling together outer body 11 and inner body 22 of rocker arm assembly 3 to rotate as an integral unit. Additionally, brake capsule 46 may be deactivated or de-energized, i.e., configured into a softened or collapsible state with the first plunger body 62 retracted, thereby preventing the first plunger body 62 from influencing and/or exerting a valve opening force on the valve bridge 42 and/or exhaust valve 50.

In this configuration, main roller 23 coupled to outer body 11 may engage an engine braking lift profile from a respective engine braking cam, transferring the corresponding lift to rocker arm 3. Additionally, secondary roller 24 coupled to inner body 22 may engage the "normal" exhaust valve lift profile from a respective exhaust valve cam, transferring the corresponding lift to rocker arm assembly 3. As a result, rocker arm 3 may receive the sum of the two valve lift profiles.

However, with the engine braking disabled in 1.5S mode, the engine braking lift profile may be designed to operate in tandem with lost motion mechanism 44 so that lost motion mechanism 44 may absorb the lift contribution of the engine braking lift portion received by rocker arm 3 in this mode and configuration. As a non-limiting example, this selective particular absorption of the braking lift contribution in 1.5S EB mode, with engine braking disabled, may occur by the partial collapse of lost motion mechanism 44, being specifically so designed to absorb this brake lift portion, until collar 138 has reached its traverse limit, and thereafter transferring motion due to the exhaust valve lift profile to the valve bridge 42 as the rocker arm assembly 3 continues to rotate. As discussed, during operation with engine braking mode disabled, brake capsule 46 may be configured to prevent the first plunger body 62 from exerting a valve opening force on the valve bridge 42, and/or on brake valve 50. Consequently, in 1.5S EB mode with engine braking disabled, both exhaust valves 50 and 52 may open responsive to being acted upon by valve bridge 42, both valves thus following only the "normal" exhaust valve lift profile of the valvetrain.

In particular embodiments featuring selective 1.5-stroke engine braking (1.5S EB) mode operation, when engine braking mode is enabled, the switchable roller mechanism, which may be provided in part or whole by latching axle assembly 30, may be configured in an unlatched mode, thereby decoupling the individual motions of outer body 11 and inner body 22 of rocker arm assembly 3. Additionally, brake capsule 46 may be activated or energized, i.e., configured into a rigid or nearly rigid state, with the first plunger body 62 extended to act on and/or provide a valve opening force on the valve bridge 42 and/or exhaust valve 50. In this configuration, main roller 23 may continue to be coupled to outer body 11, while engaging a brake lift profile from a respective engine braking cam and transferring the corresponding lift to rocker arm 3. However, while secondary roller 24 coupled to inner body 22 may still continue to engage the "normal" exhaust valve lift profile from a respective exhaust valve cam, the latter exhaust valve lift may not be transferred to rocker arm assembly 3 since inner body 22 may be decoupled from outer body 11. As a non-limiting example, the "normal" exhaust valve lift imparted to secondary roller 23 may be absorbed by lost motion spring 25.

Thus, with the engine braking enabled in 1.5S mode, rocker arm assembly 3 may receive motion responsive to a brake lift profile only. Consequently, based on plunger body 62 of brake capsule 46 being extended and acting on exhaust valve 50 (also called brake valve 50), engine braking valve opening events are provided to the cylinder, as intended. As previously mentioned, in particular embodiments of 1.5S engine braking, three or four opening events of exhaust valve 50 may occur for each cam rotation when engine braking is enabled. In this mode, lost motion mechanism 44 may act to absorb the brake lift profile portion, preventing transmission of the brake lift to valve bridge 42 and/or exhaust valve 52. As a result, exhaust valve 52 may not open at all in 1.5S mode with engine braking enabled.

In particular embodiments featuring selective 1-stroke engine braking (1S EB) mode operation, when engine braking mode is enabled, the switchable roller mechanism, which may be provided in part or whole by latching axle assembly 30, may be configured in a latched mode, thereby coupling together outer body 11 and inner body 22 of rocker arm assembly 3 to rotate as an integral unit. Therefore, as described in particular previous situations, in this 1S mode with engine braking enabled, rocker arm 3 may receive the sum of both valve lift profiles: engine braking lift via main roller 23 as well as exhaust valve lift via secondary roller 24.

Additionally, in 1S EB with engine braking mode enabled, brake capsule 46 may be activated or energized, i.e., configured into a rigid or nearly rigid state, with the first plunger body 62 extended to act on and/or provide a valve opening force on the valve bridge 42 and/or exhaust valve 50. In this configuration and mode, plunger body 62 may act on valve bridge 42 and open exhaust valve 50 (also called brake valve 50) first, while exhaust valve 52 may initially remain closed based on initial absorption of the engine braking profile by lost motion mechanism 44. Subsequently, following the opening of exhaust valve 50 by a certain predetermined distance based on engine braking lift, further rotation of outer body 11 and rocker arm assembly 3 may cause the lost motion shaft 130 of lost motion mechanism 44 to eventually act on the valve bridge 42, thereby opening second exhaust valve 52 while continuing to open the first exhaust valve 50, now based on exhaust valve lift.

In particular embodiments, brake capsule 46 may be automatically de-energized or disabled to a soft state at this stage of exhaust valve opening, in the 1S mode with engine braking enabled, so that both exhaust valves 50 and 52 may subsequently continue to open and close in tandem with each other based on lost motion mechanism 44 acting on valve bridge 42 only, i.e., without further action from brake capsule 46. In other words, in particular embodiments in 1S mode with engine braking enabled, brake capsule may asymmetrically operate on exhaust valve 50 during valve opening aspects, and then be disengaged at an intermediate instant so that exhaust valves 50 and 52 may subsequently operate in parallel through the events of both valves closing.

In particular embodiments with a 1S engine braking configuration, it may be possible to operate rocker arm 3 in a cylinder deactivation (CDA) mode. In CDA mode, the switchable roller mechanism, which may be provided in part or whole by latching axle assembly 30, may be configured in an unlatched mode, thereby decoupling the individual motions of outer body 11 and inner body 22 of rocker arm assembly 3. Additionally, brake capsule 46 may be deactivated or de-energized, i.e., configured into a softened or collapsible state with the first plunger body 62 retracted, thereby preventing the first plunger body 62 from influencing and/or exerting a valve opening force on the valve bridge 42 and/or exhaust valve 50.

Thus, in this configuration, main roller 23 may continue to be coupled to outer body 11, while engaging a brake lift profile from a respective engine braking cam and transferring the corresponding lift to rocker arm 3. However, while secondary roller 24 coupled to inner body 22 may still continue to engage the exhaust valve lift profile from a respective exhaust valve cam, the latter exhaust valve lift may not be transferred to rocker arm assembly 3 since inner body 22 may be decoupled from outer body 11. As a non-limiting example, the "normal" exhaust valve lift imparted to secondary roller 23 may be absorbed by lost motion spring 25. Additionally, lost motion mechanism 44 may absorb the lift contribution of the engine braking lift portion received by rocker arm 3 in this mode and configuration.

Consequently, in CDA mode, both exhaust valves 50 and 52 may remain always closed based on the inactive brake capsule 44 and absorption of engine braking lift by lost motion mechanism 44, thereby deactivating cylinder operation.

In particular embodiments, separate means of controlling switchable systems comprising a switchable brake capsule 46 and/or switchable latching axle assembly 30, may be provided. In particular embodiments, separately controllable sources of pressurized fluid, such as hydraulic fluid, oil, and/or control fluid, may enable independent control of actuator 100 of brake capsule 46, and latching axle assembly 30. As a non-limiting example, separately controllable oil control valves (OCVs) may be used to selectively pressurize suitable hydraulic fluid lines, such as hydraulic supply passage 160, and/or actuation ports 74, 75.

In particular embodiments, rocker shaft 18 may comprise fluid galleries for supplying lubrication fluid and/or control fluid, such as oil or other hydraulic fluid, to the various parts of rocker arm assembly 3. As a non-limiting example, lubrication fluid and/or control fluid may be provided to valve end 12, and/or one or more actuation ports 74, 75 (see FIG. 7, for example) at the cam end 13. As a non-limiting example, the outer body may be drilled or otherwise formed so that oil, hydraulic fluid, and/or control fluid may connect to the first and second actuation ports 74, 75 from the outer shaft bores. Fluid pathways may likewise be formed to supply oil, hydraulic fluid, and/or control fluid to the valve end, among other options. In particular embodiments, one or more such oil control valves (OCVs) may be used to selectively connect and disconnect suitable hydraulic fluid lines from one or more pressurized main oil channels of an engine. In particular embodiments, an Engine Control Unit (ECU) may provide control signals to the separate means of controlling the abovementioned switchable systems.

In particular embodiments, an auxiliary reset channel 210 may provide hydraulic fluid and/or control fluid connection between brake capsule 46 and the third bore 136 of lost motion mechanism 44. In particular embodiments, HLA 700 of lost motion mechanism 44 may receive hydraulic fluid and/or control fluid through HLA refilling channel 223.

In particular embodiments, a means of controlling pressurized fluid supply to one or more switchable systems may provide pressurized fluid, such as hydraulic fluid, oil, and/or control fluid, during a portion of an exhaust cycle of an engine, while disconnecting and/or depressurizing the switchable systems during other parts of the exhaust cycle of the engine. As a non-limiting example, this form of selective pressurization during a fraction of the exhaust cycle may be achieved by gating a supply channel of pressurized oil from the engine's oil pump based on indexing a supply gate to the rotation of the rocker shaft and/or the exhaust rocker arm, whereby the gate may open to fluidly connect a hydraulic line of interest to a pressurized oil supply channel from engine's oil pump based on mutual alignment at certain rotational angles, with the gate effectively closing access to the pressurized hydraulic line as the hydraulic line rotates out of alignment with the supply channel.

Figure 4:
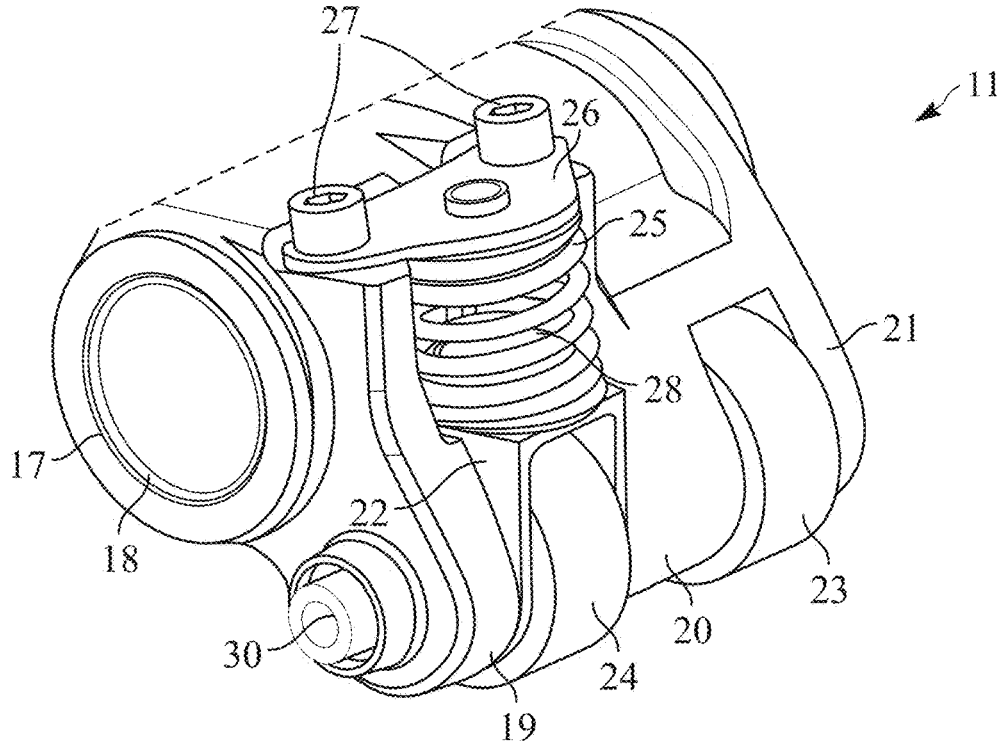
FIG. 4 illustrates a schematic partial perspective view of a cam end and inner body of a rocker arm assembly with switchable roller deactivation, according to particular embodiments.
Figure 5:
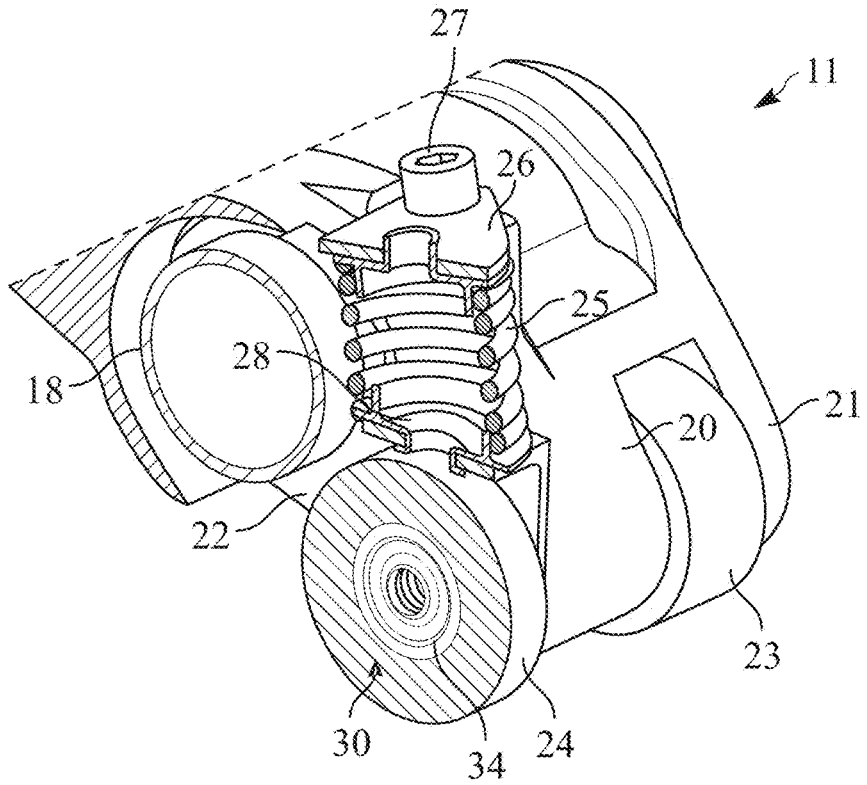
FIG. 5 illustrates a schematic cut-away partial perspective view of a cam end and inner body of a rocker arm assembly with switchable roller deactivation, according to particular embodiments.
Figure 6:
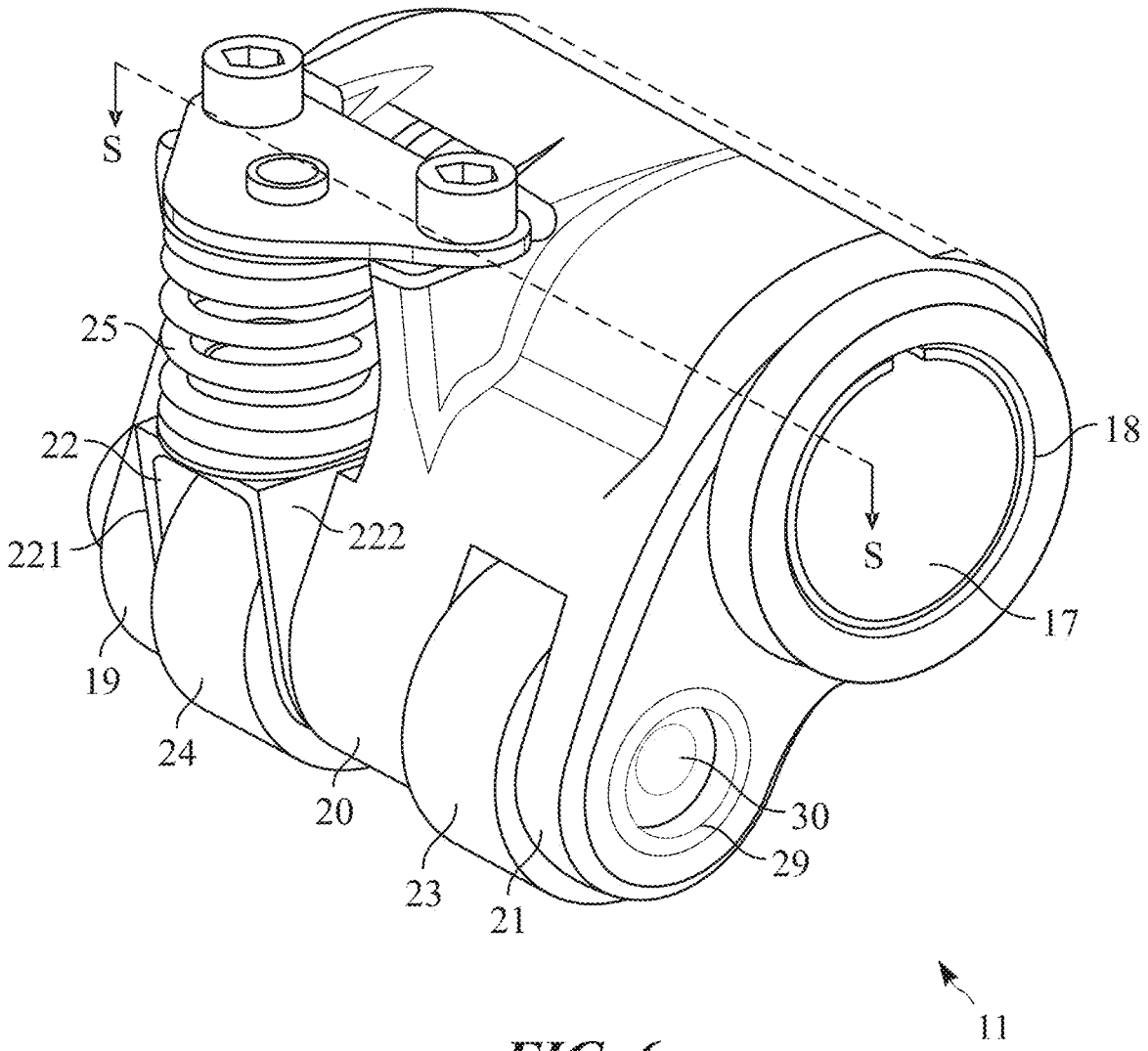
FIG. 6 illustrates another schematic partial perspective view of a cam end and inner body of a rocker arm assembly with switchable roller deactivation, according to particular embodiments.

As seen in at least FIGS. 4-6, in particular embodiments, outer body 11 may comprise cam end 13, which may further comprise at least three cam end portions, first cam end portion 19, second cam end portion 20, and third cam end portion 21, which may accommodate inner body 22, main roller 23, and secondary roller 24. In particular embodiments, inner body 22, which will be discussed in further detail in subsequent sections, may comprise an interface between secondary roller 24 and outer body 11, and may comprise an inner shaft bore 31 configured to receive rocker shaft 18, and inner axle bore 32 configured to receive latching axle assembly 30, to be further discussed below.

In particular embodiments, inner body 22 may comprise a "C"-shape to receive secondary roller 24. A portion of the inner body 22, such as inner lost motion spring retainer 28, may join inner body arms 221, 222. Inner body arms 221, 222 may be perforated so that inner shaft bore 31 and inner axle bore 32 may be formed on both sides of the "C"-shape of inner body 22. For example, rocker shaft 18 or a bushing may be seated in corresponding perforations forming inner shaft bore 31. Shaft bushing 34 may span inner axle bores 32. Main roller 23 and secondary roller 24 may be configured to interface with camshaft lobes of a valvetrain assembly.

As previously discussed, outer body 11 may include an outer shaft bore 17 that may receive an optional shaft bushing or rocker shaft 18. Rocker shaft 18 may also pass through an inner body 22, and may enable outer body 11 and inner body 22 to be rotatably coupled. For purposes of manufacture, the rocker shaft 18 does not need to be included in rocker arm assembly 3 until installation on a valvetrain. An optional bushing may be installed in rocker arm assembly 3 to stabilize the inner body 22 relative to the outer body 11 prior to installation in a valvetrain.

As mentioned elsewhere in this disclosure, it will also be appreciated that inner body 22 may be coupled to outer body 11 by a separate shaft, i.e., provided separately from the rocker shaft, in particular embodiments (not shown), so that the separate shaft may be provided to rotate about an axis parallel to rocker shaft 18.

In particular embodiments, lost motion spring 25, positioned between outer body 11 and inner body 22, may comprise a first end connected to inner body 22 and a second end connected to outer body 11. In particular embodiments, lost motion spring 25 may be secured to outer body 11 by outer lost motion spring retainer 26 which may, in turn, be secured to outer body 11 via outer lost motion spring retainer posts 27. Other fasteners may be used to secure lost motion spring retainer 25 to outer body 11, such as screws, nuts, rivets, among other options. Lost motion spring 25 may be secured to inner body 22 by inner lost motion spring retainer 28. Other fasteners may be used, such as piston assemblies. So too, other sources of lost motion spring tension may be used.

In particular embodiments, latching axle assembly 30 may be installed in an axle bore 29 that may extend through cam end portion 20 of outer body 11, as well as inner body 22, main roller 23, and secondary roller 24. Axle bore 29, when passing through outer body 11, may be known as an outer axle bore 291. Additional portions of the axle bore 29 may comprise second and third outer axle bores 292, 293 formed in the second cam end portion 20 and third cam end portion 21, respectively. Axle bore 29 may be configured to receive latching axle assembly 30. Latching axle assembly 30, like axle bore 29, may extend through first cam end portion 19, second cam end portion 20, and third cam end portion 21 of outer body 11, inner body 22, main roller 23, and secondary roller 24. Latching axle assembly 30, which comprises at least one latching mechanism, will be discussed further below.

FIG. 6 illustrates another schematic partial perspective view of a cam end and inner body of a rocker arm assembly with switchable roller deactivation, according to particular embodiments. As illustrated in FIG. 6, rocker shaft 18 may be configured to pass completely through outer body 11 and inner body 22 in particular embodiments. While other embodiments may feature inner body 22 rotatably coupled to outer body 11 at an axis parallel to rocker shaft 18, other features and aspects may continue to be commonly shared between embodiments. In particular embodiments, latching axle assembly 30 may pass completely through outer body 11 through first cam end portion 19, second cam end portion 20, and third cam end portion 21, as well as inner body 22, main roller 23, and secondary roller 24.

Figure 9:
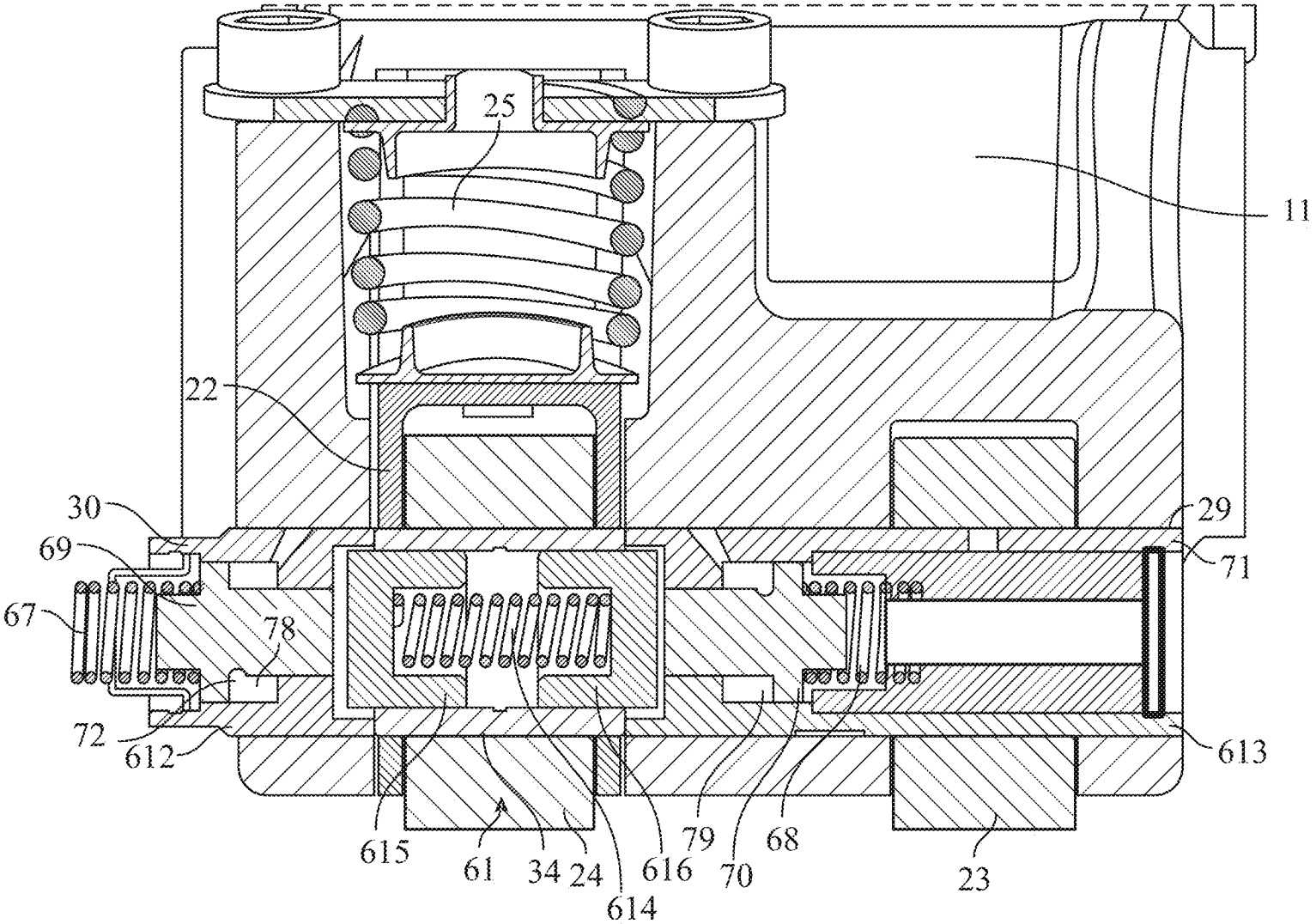
FIG. 9 illustrates a schematic partial cut-away profile view of a cam end and inner body of a rocker arm assembly with switchable roller deactivation in latched mode in a cam base circle position, the cut-away taken approximately at line S-S of FIG. 6, according to particular embodiments.

As illustrated in FIG. 6, secondary roller 24 may be in a latched state of FIG. 9 or the unlatched state of FIG. 7. When the secondary roller 24 is latched as in FIG. 9, secondary roller 24 and inner body 22 may remain fixed with respect to outer body 11, and inner body 22 may be unable to pivot relative to outer body 11, and vice versa, in particular embodiments. Any force from the camshaft lobe and resulting motion may be conveyed to valve end 12 of outer body 11. Lost motion spring 25 may remain uncompressed. Note that main roller 23, like secondary roller 24, may be fixed with respect to outer body 11.

Figure 8:
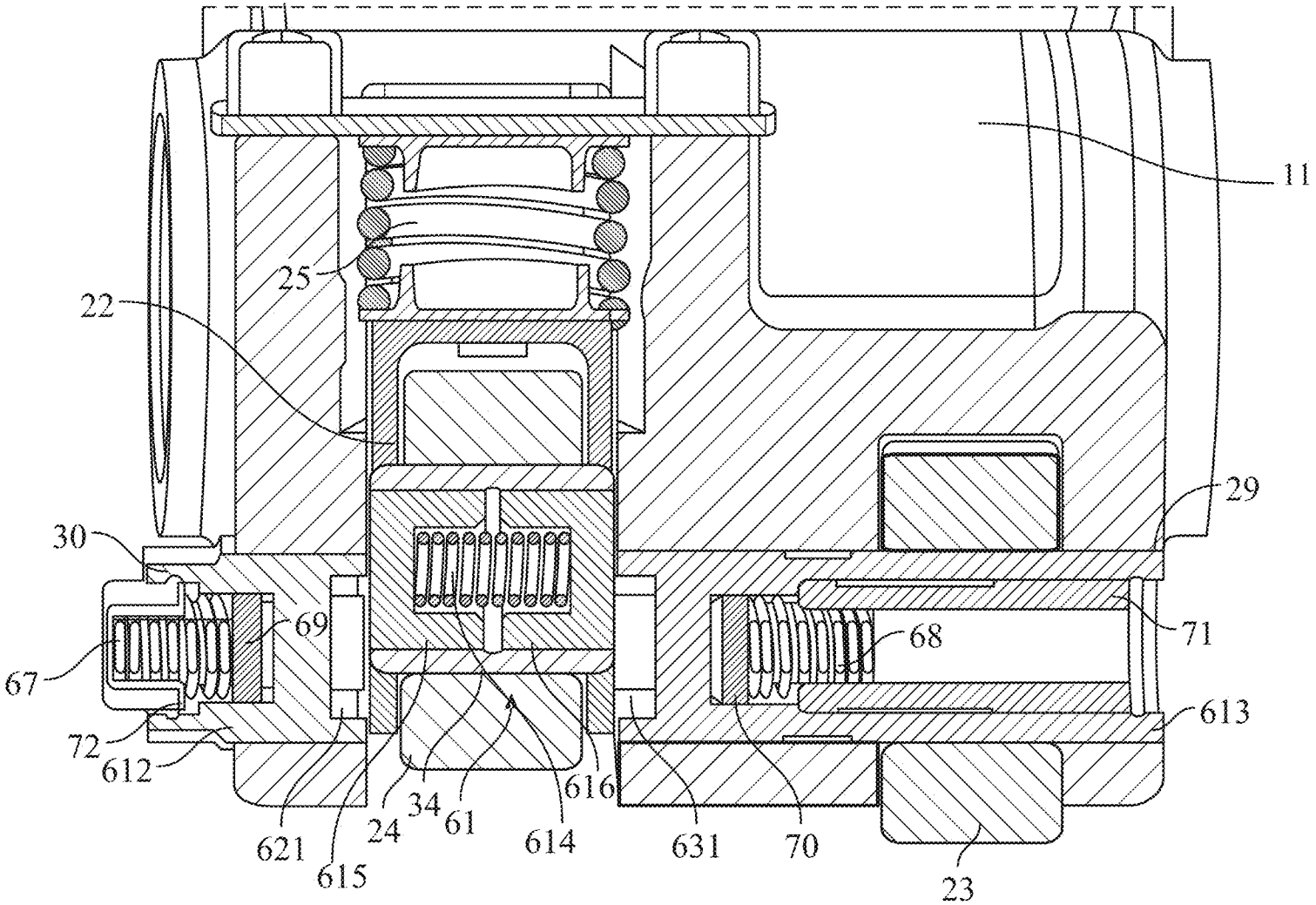
FIG. 8 illustrates a schematic partial cut-away profile view of a cam end and inner body of a rocker arm assembly with switchable roller deactivation in unlatched mode illustrating an offset roller, the cut-away taken approximately at line S-S of FIG. 6, according to particular embodiments.

FIG. 7 illustrates a schematic partial cut-away profile view of a cam end and inner body of a rocker arm assembly with switchable roller deactivation in unlatched mode, the cut-away taken approximately at line S-S of FIG. 6, according to particular embodiments. FIG. 8 illustrates a schematic partial cut-away profile view of a cam end and inner body of a rocker arm assembly with switchable roller deactivation in unlatched mode illustrating an offset roller, the cut-away taken approximately at line S-S of FIG. 6, according to particular embodiments. FIG. 9 illustrates a schematic partial cut-away profile view of a cam end and inner body of a rocker arm assembly with switchable roller deactivation in latched mode in a cam base circle position, the cut-away taken approximately at line S-S of FIG. 6, according to particular embodiments.

In particular embodiments, axle bore 29 may run through outer body 11 and main roller 23. Inner axle bore 32 may run through inner body 22 and secondary roller 24. Axle bore 29 and inner axle bore 32 may be configured to receive latching axle assembly 30. Latching axle assembly 30 may form an axle on which main roller 23 and secondary roller 24 may roll, but may also comprise at least one roller latch assembly 61 and one first latch receiver assembly 612, though optional second latch receiver assembly 613 is additionally shown here. In particular embodiments, roller latch assembly 61 may be operatively coupled to inner body 22 and secondary roller 24. First latch receiver assembly 612 and second latch receiver assembly 613 may be operatively coupled to outer body 11. One latch receiver assembly may be coupled to main roller 23. Or, main roller 23 may be coupled via separate mechanisms to outer body 11. At least one latch receiver assembly should be coupled to outer body 11.

In particular embodiments, roller latch assembly 61 may comprise latch pin spring 614, first latch pin 615, and second latch pin 616. Roller latch assembly 61 may be seated in shaft busing 34. Shaft bushing 34 may be inserted in inner axle bores 32 of inner body arms 221, 222, or shaft bushing 34 may be integrally formed with inner body arms 221, 222. While two latch pins are illustrated, it may be possible to use only one latch pin and one latch receiver assembly in particular embodiments. The second latch pin may be converted to a blind bore or other spring-seating surface for latch pin spring 614, such as a plug or circlip. Secondary roller 24 may be mounted to shaft bushing 34. Roller latch assembly 61 may interlock with at least the first latch receiver assembly 612 as described below.

In particular embodiments, it may be possible to include spacers or travel limits in the roller latch assembly 61. First latch pin 615 and second latch pin 616 are illustrated as hollow pistons that may cup the latch pin spring 614. The first latch pin 615 and second latch pin 616 may comprise body portions that may be slidable within shaft bushing 34. The body portions may extend from roller latch assembly 61 to seat in first latch receiver assembly 612 and second latch receiver assembly 613. First latch pin 615 and second latch pin 616 may be slidable within first latch receiver assembly 612 and second latch receiver assembly 613, respectively, to enable a latching mode. Each end of latch pin spring 614 may be biased, effectively anchored, to each of first latch pin 615 and second latch pin 616. In particular embodiments, an alternative may include a divider wall and two latch pin springs 614. If only one latch pin is present, one end of latch pin spring 614 may be biased against first latch pin 615 while the other end of latch pin spring 614 may be otherwise biased against the interior of roller latch assembly 61. Roller latch assembly 61 may also comprise mechanisms to anchor first latch pin 615 and second latch pin 616 to a latch guide rod or to the interior of roller latch assembly 61 for such purposes as travel limiting, force distribution, among others.

In particular embodiments, first latch receiver assembly 612 may comprise first piston spring 67, first piston 69, and first spring chamber 72. Second latch receiver 613 may comprise second piston spring 68, second piston 70, guide rod 71, and second spring chamber 73. First spring chamber 72 may be formed in the interior of first latch receiver assembly 612. A mating retainer 671 such as a cap or cage may secure the first piston spring 67 in place. Second spring chamber 73 may also be formed in the interior of second latch receiver assembly 613. First spring chamber 72 and spring pressure chamber 73 may be sized so that first piston spring 67 and second piston spring 68 may bias the first piston 69 and second piston 70 against the roller latch assembly 61. The spring forces may be balance to either bias the roller latch assembly 61 to the latched mode or the unlatched mode, as design choices. As drawn, the spring forces among the latch pin spring 614, the first piston spring 67 and the second piston spring 68 may be balanced so that the secondary roller 24 may be in a default unlatched mode, in particular embodiments. The first and second latch pins 615 and 616 may be unlatched from the receiving cups 621 and 631, respectively.

In particular embodiments, at start-up of a related vehicle or machine, a deactivation sequence may be followed. First pressure chamber 78 may be operatively coupled to first actuation port 74 from which control fluid may enter first pressure chamber 78. When control fluid is depressurized, it may exit first pressure chamber 78 via leak down paths. A bleed port may be included in a retainer, as an option (not shown). Second pressure chamber 79 may be operatively coupled to second actuation port 75. Optional bleed port 76 and lubrication port 77 may be included. Second actuation port 75 may allow control fluid to enter second pressure chamber 79. When control fluid is depressurized, it may exit second pressure chamber 79 via bleed port 76 and leak down paths. Lubrication port 77 may allow the flow of lubricating fluid to main roller 23. The control fluid may cause the first piston 69 and second piston 70 to withdraw into the first and second latch receiver assemblies 612, 613, respectively. Then, the first and second latch pins 615 and 616, may push outward to respectively latch in receiving cups 621 and 631 for the latched mode. Should a biased-latched mode be desired, it may be possible, in particular embodiments, to reverse the spring chambers 72 and 73 and pressure chambers 78 and 79, respectively, and move the first and second actuation ports 74 and 75 to feed spring chambers 72 and 73 to push the first and second pistons 69 and 70, respectively.

In particular embodiments, guide rod 71 may be seated in the interior of second latching receiver assembly 613. Guide rod 71 may be configured to provide a portion of the second spring chamber 73. Guide rod 71 may be secured in place by a retainer such as a snap-ring, washer, plug, stake or the like. Second piston 70 may be slidably mounted in the second latching receiver assembly 613. One end of second piston spring 68 may be biased against guide rod 71 while the other end of second piston spring 68 may be biased against second piston 70. The second piston spring 68 may oppose the spring force from latch pin spring 614 conveyed by second latch pin 616.

In particular embodiments, for shorter latch receivers, guide rod 71 may be excluded with, for example, first piston 69 slidably mounted within first latch receiver assembly 612. A first end of first piston spring 67 may be seated in the interior of first latch receiver assembly 612 and a second end of first piston spring 67 may be seated against first piston 69.

Alternatively, in particular embodiments, first latch receiver assembly 612 may also comprise a guide rod with first piston 69 slidably mounted to the guide rod. A first end of first piston spring 67 may be affixed to the guide rod while the other end of first piston spring 67 may be seated against first piston 69.

Configurations for latch receivers with or without guide rod 71 may be combined in particular embodiments, e.g., one receiver with a guide rod and another receiver without a guide rod as shown above. Or, configurations may comprise two receivers each with a guide rod, or two receivers both without guide rods. Furthermore, roller latch assembly 61 may be configured to operate with only a single latch pin and/or only a single latch receiver, rather than two of each, in particular embodiments.

First piston spring 67 and second piston spring 68 may exert greater force than latch pin spring 614 in particular embodiments. As seen in FIG. 7, when roller latch assembly 61 is in unlatched mode, the control fluid in pressure chambers 78, 79 may be at a relatively low pressure, and first piston spring 67 and second piston spring 68 may push first piston 69 and second piston 70, respectively, and, in turn, first latch pin 615 and second latch pin 616, thereby compressing latch pin spring 614 such that first latch pin 615 and second latch pin 616 may be clear of first latch receiver assembly 612 and second latch receiver assembly 613. This may allow roller latch assembly 61 with secondary roller 24 and inner body 22 to swing free of outer body 11 as seen in FIG. 8, and may allow secondary roller 24 and inner body 22 to pivot relative to outer body 11. Forces from cam lobes may be transmitted directly or indirectly via secondary roller 24 thereby compressing lost motion spring 25, in particular embodiments.

As illustrated in FIG. 9, roller latch assembly 61 may be in latched mode. In particular embodiments, tension from lost motion spring 25 may place roller latch assembly 61 in alignment with first latch receiver assembly 612 and second latch receiver assembly 613, such that first latch pin 615 and second latch pin 616 of roller latch assembly 61 may interlock with receiving cups 621, 631, respectively, of first latch receiver assembly 612 and second latch receiver assembly 613. In first pressure chamber 78 and second pressure chamber 79, pressurized control fluid may be directed at first piston 69 and second piston 70. This may overcome the spring forces of first piston spring 67 and second piston spring 68, allowing the latch pin spring 614 to extend and force first latch pin 615 and second latch pin 616 to latch in receiving cups 621, 631 of first latch receiver assembly 612 and second latch receiver assembly 613.

While particular disclosed embodiments may detail a roller latch assembly 61 capable of latching and unlatching only secondary roller 24, the mechanisms of roller latch 61 may be readily modified and additional roller latch assemblies may be configured to accommodate latching and unlatching of additional rollers.

While particular disclosed embodiments may describe a rocker arm assembly configured as an exhaust rocker arm assembly with a main roller and a secondary roller, a rocker arm assembly may be suitably modified to allow for fewer or additional rollers, and/or as an intake rocker valve assembly, any combination of which may be capable of latching and unlatching.

Other implementations will be apparent to those skilled in the art from consideration of the specification and practice of the examples disclosed herein.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

Numerical ranges recited in this application should be construed to be inclusive of the end points of the stated ranges. The longitudinal axis of the valve body, which may have been omitted in some illustrations for convenience of scale, should be construed to exist in every illustration where it is referred to.

The invention claimed is:

1. An integrated exhaust rocker arm assembly capable of selectively enabling one or more engine braking modes, the integrated exhaust rocker arm assembly comprising:

an outer body configured to rotate about a rocker shaft, the outer body comprising a valve end and a cam end opposite the valve end, the valve end configured to selectively operatively engage with one or more of a first exhaust valve or a second exhaust valve, the valve end of the outer body further comprising:

a brake capsule, the brake capsule comprising a first switchable system configured to selectively extend a first plunger body to a first position to operatively engage with the first exhaust valve; and a lost motion mechanism comprising a lost motion shaft configured to translate along a lost motion receiving passage to selectively absorb or transmit motion of the outer body to one or more of the first exhaust valve or the second exhaust valve;

a main roller operatively coupled to the cam end of the outer body and configured to operatively engage with a first cam, wherein the first cam is provided with an engine braking lift profile associated with motion of one or more of the first exhaust valve or the second exhaust valve when a first type of engine braking mode is enabled;

an inner body configured to rotate about an axis parallel to the rocker shaft;

a secondary roller operatively coupled to the inner body and configured to operatively engage with a second cam, wherein the second cam is provided with an exhaust valve lift profile associated with motion of one or more of the first exhaust valve or the second exhaust valve when the first type of engine braking mode is disabled; and a second switchable system configured to selectively operatively couple the outer body to the inner body, wherein, when the first type of engine braking mode is enabled, the outer body and the inner body are operatively decoupled by the second switchable system to prevent transfer of motion due to the second cam to the outer body; and the first plunger body is extended to the first position by the first switchable system, the first plunger body opening the first exhaust valve based on the engine braking lift profile received by the main roller, the second exhaust valve remaining closed throughout an engine operating cycle based on the lost motion mechanism absorbing the engine braking lift profile received by the main roller.

2. The integrated exhaust rocker arm assembly of claim 1, the lost motion mechanism further comprising an integrated hydraulic lash adjuster configured to compensate for lash between the lost motion shaft and a valve bridge during operation of the integrated exhaust rocker arm assembly, the valve bridge associated with one or more of the first exhaust valve or the second exhaust valve.

3. The integrated exhaust rocker arm assembly of claim 1, the second switchable system comprising a roller latch assembly and a latch receiver assembly.

4. The integrated exhaust rocker arm assembly of claim 3, the second switchable system further comprising a first lost motion spring operatively coupled to the outer body and the inner body.

5. The integrated exhaust rocker arm assembly of claim 3, the roller latch assembly comprising a latch pin, the latch pin configured to move between a latched position, wherein the latch pin engages with the latch receiver assembly to constrain relative rotation between the inner body and the outer body, and an unlatched position, wherein the latch pin disengages from the latch receiver assembly to permit relative rotation between the inner body and the outer body.

6. The integrated exhaust rocker arm assembly of claim 3, wherein the cam end of the outer body further comprises an outer axle bore for seating the latch receiver assembly.

7. The integrated exhaust rocker arm assembly of claim 3, wherein operative decoupling of the outer body and the inner body when the first type of engine braking mode is enabled is associated with providing pressurized oil through a first controllable hydraulic line, the pressurized oil acting on the roller latch assembly.

8. The integrated exhaust rocker arm assembly of claim 1, wherein the brake capsule is a hydraulic brake capsule.

9. The integrated exhaust rocker arm assembly of claim 8, wherein the first switchable system comprises an actuator configured to selectively release oil pressure in the brake capsule.

10. The integrated exhaust rocker arm assembly of claim 9, wherein the first plunger body occupying the first position is associated with providing pressurized oil through a second controllable hydraulic line, the pressurized oil acting on the actuator.

11. The integrated exhaust rocker arm assembly of claim 9, wherein the actuator comprises a needle and a check ball, the needle comprising a longitudinal pin portion and a disk portion, the needle configured to selectively open the check ball.

12. The integrated exhaust rocker arm assembly of claim 1, further comprising a valve bridge configured to selectively engage with one or more of the first exhaust valve or the second exhaust valve, wherein the lost motion mechanism is longitudinally aligned with the center of the valve bridge.

13. The integrated exhaust rocker arm assembly of claim 1, wherein the brake capsule is longitudinally aligned with the first exhaust valve.

14. The integrated exhaust rocker arm assembly of claim 1, further wherein, when the first type of engine braking mode is disabled, the outer body and the inner body are operatively coupled by the second switchable system to form a coupled member to permit transfer of a component of motion associated with the exhaust valve lift profile and received from the second cam by the secondary roller; and the first plunger body is retracted to a second position and configured into a collapsible state by the first switchable system, thereby preventing operative engagement of the first plunger body with the first exhaust valve, whereupon the lost motion mechanism selectively acts to open one or more of the first exhaust valve or the second exhaust valve based on the component of motion of the coupled member associated with the exhaust valve lift profile, the lost motion mechanism absorbing a component of motion associated with the engine braking lift profile received from the first cam by the main roller.

15. The integrated exhaust rocker arm assembly of claim 14, further comprising a locking mechanism configured to selectively mechanically constrain the first plunger body to the second position when the first type of engine braking mode is disabled.

16. A method of operating a valvetrain system comprising an integrated exhaust rocker arm assembly, the method comprising, when a first type of engine braking mode is enabled:

operating a switchable coupling system to decouple an outer body and an inner body of the integrated exhaust rocker arm assembly, wherein the outer body is configured to rotate about a rocker shaft, the outer body operatively connected to receive an engine braking lift profile from a first cam, and wherein the inner body is configured to rotate about an axis parallel to the rocker shaft, the inner body operatively connected to receive an exhaust valve lift profile from a second cam, so that the decoupling prevents transfer of motion due to the second cam to the outer body;

operating a switchable capsule system to extend a first plunger body of a brake capsule associated with the outer body to a first position, the first plunger body in the first position acting to open a first exhaust valve based on the engine braking lift profile received from the first cam, and maintaining a second exhaust valve closed throughout an engine operating cycle based on a lost motion mechanism associated with the outer body absorbing the engine braking lift profile received from the first cam.

17. The method of claim 16, wherein the lost motion mechanism comprises a lost motion shaft and an integrated hydraulic lash adjuster that continually compensates for lash between the lost motion shaft and a valve bridge during operation of the valvetrain system, the valve bridge associated with one or more of the first exhaust valve or the second exhaust valve.

18. The method of claim 16, the method comprising, when the first type of engine braking mode is disabled:

operating the switchable coupling system to operatively couple the outer body and the inner body; and operating the switchable capsule system to retract the first plunger body of the brake capsule to a second position, thereby preventing operative engagement of the first plunger body with the first exhaust valve, whereupon the lost motion mechanism selectively acts to open one or more of the first exhaust valve or the second exhaust valve based on the exhaust valve lift profile received from the second cam by the inner body.

19. A valvetrain system of an engine, the valvetrain system capable of selectively enabling an engine braking mode and comprising:

a plurality of exhaust valves associated with a cylinder of the engine and comprising a first exhaust valve and a second exhaust valve;

one or more exhaust cam shafts associated with the cylinder of the engine and comprising an engine braking cam and an exhaust valve cam, the engine braking cam provided with an engine braking lift profile associated with motion of one or more of the first exhaust valve or the second exhaust valve when the engine braking mode is enabled, the exhaust valve cam provided with an exhaust valve lift profile associated with motion of one or more of the first exhaust valve or the second exhaust valve when the engine braking mode is disabled; and an exhaust rocker arm associated with the cylinder of the engine and configured to rotate about a rocker shaft, the exhaust rocker arm comprising:

an outer body comprising a valve end and a cam end opposite the valve end, the valve end configured to selectively operatively engage with one or more of the first exhaust valve or the second exhaust valve, the valve end of the outer body further comprising:

a brake capsule, the brake capsule comprising a first switchable system configured to selectively extend a first plunger body to a first position to operatively engage with the first exhaust valve; and a lost motion mechanism comprising a lost motion shaft configured to translate along a lost motion receiving passage to selectively absorb or transmit motion of the outer body to one or more of the first exhaust valve or the second exhaust valve;

a main roller operatively coupled to the cam end of the outer body and configured to operatively engage with the engine braking cam;

an inner body configured to rotate about an axis parallel to the rocker shaft;

a secondary roller operatively coupled to the inner body and configured to operatively engage with the exhaust valve cam; and a second switchable system configured to selectively operatively couple the outer body to the inner body, wherein, when the engine braking mode is enabled, the outer body and the inner body are operatively decoupled by the second switchable system to prevent transfer of motion due to the exhaust valve cam to the outer body; and the first plunger body is extended to the first position by the first switchable system to open the first exhaust valve based on the engine braking lift profile received by the main roller, the second exhaust valve remaining closed throughout an engine operating cycle based on the lost motion mechanism absorbing the engine braking lift profile received by the main roller.

* * * * *